US007142792B2

(12) United States Patent
Tanaka et al.

(10) Patent No.: US 7,142,792 B2
(45) Date of Patent: Nov. 28, 2006

(54) FIXING APPARATUS

(75) Inventors: Hajime Tanaka, Hachioji (JP); Hidetoshi Katayanagi, Tokyo (JP); Masashi Saito, Hino (JP); Toshiki Hayami, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 191 days.

(21) Appl. No.: 10/859,793

(22) Filed: Jun. 3, 2004

(65) Prior Publication Data

US 2005/0008383 A1 Jan. 13, 2005

(30) Foreign Application Priority Data

Jul. 9, 2003 (JP) ..... 2003-194200
Jul. 15, 2003 (JP) ..... 2003-197035
Jul. 15, 2003 (JP) ..... 2003-197036

(51) Int. Cl.
*G03G 15/20* (2006.01)

(52) U.S. Cl. ..... 399/67; 399/69; 399/333

(58) Field of Classification Search ..... 399/67, 399/69, 330–334
See application file for complete search history.

(56) References Cited

U.S. PATENT DOCUMENTS 6,678,497 B1 * 1/2004 Murata ..... 399/323
6,810,220 B1 * 10/2004 Hamada et al. ..... 399/69
2002/0090237 A1 * 7/2002 Tanaka et al. ..... 399/328
2003/0180075 A1 * 9/2003 Hayami et al. ..... 399/328

FOREIGN PATENT DOCUMENTS

JP 58125077 A * 7/1983
JP 06-048600 2/1994
JP 06118818 A * 4/1994
JP 06-230695 8/1994
JP 07-312675 11/1995
JP 2001-042679 2/2001
JP 2003-015459 1/2003

* cited by examiner

*Primary Examiner*—Edward Lefkowitz
*Assistant Examiner*—Ryan Gleitz
(74) *Attorney, Agent, or Firm*—Lucas & Mercanti, LLP

(57) ABSTRACT

The fixing apparatus prevents transfer paper from sticking or jamming. This fixing apparatus is intended to fix polymerized toner on transfer material and has a heating roller and a pressure roller. The difference in hardness between the heating roller and pressure roller is 5 through 10 degrees in AskerC, and the hardness of the pressure roller is higher than that of the heating roller. A fixing nip portion, convex-shaped on the side closest to the heating roller, is formed between the heating roller and pressure roller and the nip pressure of the fixing nip portion is 24.5 N/cm or more.

20 Claims, 10 Drawing Sheets

FIXING APPARATUS

BACKGROUND OF THE INVENTION

1. Field of The Invention

The present invention relates to a fixing apparatus provided on an electrophotographic image forming system such as a copying machine, printer or fax machine, and an image forming apparatus using the same.

2. Description of Related Art

The fixing apparatus, used so far in the electrophotographic image forming system such as a copying machine, printer or fax machine, having a heating roller member (heating roller or upper roller) and a pressure roller member (pressure roller or lower roller), is often the fixing apparatus of a heating roller fixing type, wherein the transfer material with unfixed toner image formed thereon is heated as it is held and transported by a heating roller having an elastic layer (rubber roller layer) and maintained at a predetermined temperature and a pressure roller in contact with this heating roller and equipped with an elastic layer.

In the apparatus of this type, however, the heating roller has a large heat capacity, and hence requires a longer heating up time, resulting in a higher temperature inside the elastic layer and a reduced service life of the heating roller.

Further, there has been a growing requirement for energy saving, and development efforts are being made to provide a fixing apparatus that ensures a higher fixing performance without increasing the power consumption. There has been a trend for upgrading the surface gloss of the image by the fixing section in order to meet the requirements for higher quality. To provide a technique for improving the image quality, an image forming apparatus using an oil-free fixing apparatus (where no oil is used) in the fixing process is coming on the market.

A device for separating stacked materials including the transfer materials and documents is disclosed in the Official Gazette of Japanese Patent Tokkaihei 6-48600 containing the description of a stacked material separator capable of forming the separation member by a simple method and transporting the separated materials without the stacked materials being damaged.

However when the separation function of the above-mentioned stacked material separator or document image reader is applied to the above-mentioned fixing apparatus, and a flat fixing nip portion is formed by adjusting the hardness of the elastic layer (rubber roller layer) of the fixing roller having a heating roller member (heating roller or upper roller) and pressure roller member (pressure roller or lower roller), an oil application mechanism becomes necessary if separability of the filled-in image is to be ensured. This has presented a problem from the viewpoint of paper handing and copying costs.

To solve this problem, the fixing nip portion was made in upwardly convex shape (for increasing the distortion of the heating roller member) so as to prevent it from jamming on the heating roller member (upper roller), and to eliminate the need of using an oil application mechanism, thereby upgrading the paper handling performance and reducing the copying costs. In this case, however, when paper feeding performance of high printing percentage was ensured by increasing the degree of the upwardly convex of the upwardly convex fixing nip portion (for increasing the distortion of the heating roller member), a problem was found in the jamming of the transfer material on the pressure roller member (lower roller) when a blank sheet of paper was fed (during feed of a black sheet of paper).

A document image reader for enhancing the degree of freedom in the document feed direction by preventing the documents from jamming is disclosed in the Official Gazette of Japanese Patent Tokkaihei 7-312675.

The Official Gazette of Japanese Patent Tokkaihei 6-230695 discloses one of the known examples of the fixing apparatus, wherein an elastic layer having a hardness of 65 degrees (AskerC) and a wall thickness of 3 mm or more is provided on the outer periphery of the shaft; the durability of the fixing roller is improved with respect to:

a heating roller member (heating roller or upper roller) covered with a releasing layer on the outer periphery, and a pressure roller member (pressure roller or lower roller) incorporating a heater to heating the heating roller member from the outside while rotating in close contact with the heating roller member; and the time for waiting the fixing operation is reduced according to the type of the transfer material to be fixed and the formation of the transmission image.

However, an oil-free fixing apparatus could not be provided by the prior art flat type fixing nip portion having the same hardness on the upper and lower portions; jamming of the transfer material on the heating roller member (upper roller) was observed. To solve this problem with jamming, the nip portion was formed in an upwardly convex shape, but the transfer material was curled at the nip portion (fixing nip portion), so it was round around the pressure roller member (lower roller). When an image was formed on both faces of the transfer material, the transfer material came in contact with the separation jaw of the lower roller (pressure roller member) to cause a damage to be produced on the image.

In an electrophotographic image forming system, the transfer material such as recording paper with a toner image of a photoconductor transferred thereon is transported to the nip portion of the heating roller and pressure roller member rotating in contact with each other, whereby fixing is carried out. In this case, the toner on the transfer material is offset on the heating roller, the transfer material are jammed on the heating roller or pressure roller, or the surface gloss is changed by the mutual pressing force between both rollers.

One of means for avoiding such offsetting or jamming onto the heating roller is disclosed in the Official Gazette of Japanese Patent Tokkai 2001-42679, where electric charge of the same polarity as that of the toner and opposite to that of the transfer material is applied to two rollers by the electric charge produced when the transfer material is transported by the heating roller and pressure roller, and a greater amount of electric charge is applied to the pressure roller member in such a way that the transfer material is fed closer to the pressure roller member.

One of the means for solving the problem with changing the surface gloss is described in the Official Gazette of Japanese Patent Tokkai 2003-15459, which discloses an adjusting device where the pressing force resulting from the contact between two rollers can be changed.

However, subtle factors causing instability are found out in the method disclosed in the Official Gazette of Japanese Patent Tokkai 2001-42679, where electric charge of the same polarity as that of the toner and opposite to that of the transfer material is applied and a greater a mount of electric charge is applied to the pressure roller member in such a way that the transfer material is fed closer to the pressure roller member. Considerable difficulties are considered to be involved in the method of stabilizing the surface gloss by using an adjusting device where the pressing force resulting from the contact between two rollers is adjusted, as disclosed in the Official Gazette of Japanese Patent Tokkai 2003-15459.

In view of the prior art problems described above, it is an object of the present invention to avoid the problems that may be raised by the jamming of the transfer material onto the heating roller and pressure roller when an upwardly convex shaped fixing nip portion is formed in the fixing section. Another object of the present invention is to prevent jamming and to enhance the transfer material ejection performance from the fixing section.

SUMMARY

A fixing apparatus for fixing polymerized toner on transfer material has a) a heating roller having a cylindrical cored bar, and a elastic layer and releasing layer provided around said cylindrical cored bar; b) a pressure roller, in contact with the heating roller, having a cylindrical cored bar, and a elastic layer and releasing layer provided around said cylindrical cored bar; c) a first guide member provided opposite the pressure roller; and d) a second guide member. provided near the heating roller without contacting thereto;

In this fixing apparatus, the difference in hardness between the heating roller and pressure roller is 5 through 10 degrees in AskerC, And the hardness of the pressure roller is higher than that of the heating roller. Further, a fixing nip portion, convex-shaped on the side closest to the heating roller, is formed between the heating roller and pressure roller.

DETAILED DESCRIPTION OF THE PREFERRED EMBODIMENT

The following describes the preferred embodiments of the present invention. It should be noted that the following description does not restrict the technological scope or terminology in the present Claims.

(1) An image forming apparatus using the fixing apparatus of the present invention will be described with reference to FIG. 1.

Figure 1:
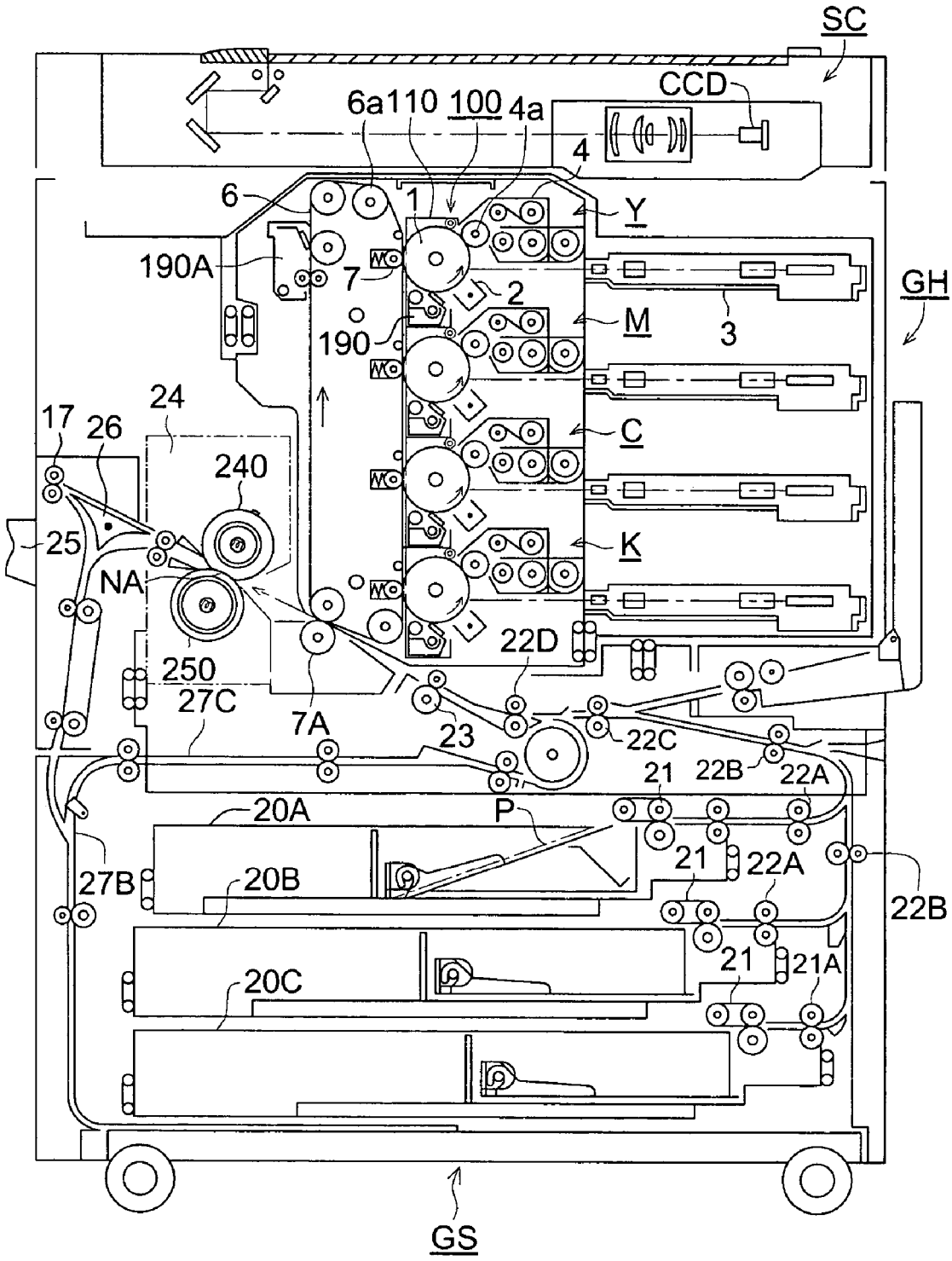
FIG. 1 is a block diagram showing the cross section of a fixing apparatus and an image forming apparatus incorporating the same as an embodiment of the present invention.

In FIG. 1, the image forming apparatus GS has an image forming apparatus proper GH and an image reader SC mounted on the top of the image forming apparatus proper GH.

The image forming apparatus proper GH is what is called the tandem color image forming apparatus. Image forming units for forming color toner images of yellow, magenta, cyan and black are arranged along the traveling direction of an intermediate transfer body. The color toner images formed on the image carriers of the image forming units are multi-transferred and superimposed onto an intermediate transfer body, and are then transferred onto a transfer material in one operation.

In FIG. 1, a document image placed on the image reader SC installed on the top of the image forming apparatus proper GH is scanned and exposed by an optical system, and is read into the line image sensor CCD. The analog signal subject to photoelectric conversion by the line image sensor CCD is subject to analog processing, analog-to-digital conversion, shading correction and image decompression by the image processing section, and the image data signal is then sent to an exposure optical system 3 as image write means.

In FIG. 1, four process units 100 to form images of colors yellow (Y), magenta (M) cyan (C) and black (K) as color toner image forming means are arranged on the periphery of the intermediate transfer belt 6 as an intermediate transfer body, in a single file perpendicularly along the intermediate transfer belt 6, with reference to the rotational direction of the intermediate transfer belt 6 in the vertical direction shown by an arrow mark. They are arranged in the order of Y, M, C and K.

These four process units 100 have a common structure. Each of the units has a photoconductor drum 1 as an image carrier, a charging device 2 as electric charging means, an exposure optical system 3 and a developing device 4 and a photoconductor cleaning apparatus 190.

The photoconductor drum 1 as an image carrier is composed of a photoconductive layer of organic photosensitive layer (OPC) having a layer thickness (film thickness) of 20 through 40 μm as a thickness of photoconductive layer, formed on its outer periphery of a cylindrical substrate formed of the metallic member such as aluminum having an approximate external diameter of 40 through 100 mm. With the conductive layer connected to the ground, the photoconductor drum 1 is driven at a linear velocity of 80 through 280 mm per second, preferably, at a linear velocity of 220 mm per second in the arrow-marked direction by the power from a drive source (not illustrated).

An image forming section comprising a set of a charging device 2 as electric charging means, an exposure optical system 3 as image write means and a developing device 4 as developing means is arranged around the photoconductor drum 1, in the rotational direction of the photoconductor drum 1 indicated by the arrow-mark in FIG. 1.

The charging device 2 as electric charging means is mounted opposite and close to the photoconductor drum 1, in the direction (vertical direction in FIG. 1) orthogonal to the traveling direction of the photoconductor drum 1. The charging device 2 is equipped with a discharge wire as a corona discharge electrode for applying a predetermined potential to the organic photosensitive layer (OPC) of the photoconductor drum 1. It provides electric charging (negative charging in the present embodiment) by the corona discharge in the same polarity as toner, and applies uniform potential to the photoconductor drum 1.

The exposure optical system 3 as image write means scans the laser beam issued from the semiconductor laser (LD) light source (not illustrated), by rotation in the main scanning direction using a rotating polygon mirror, and performs exposures (write the image) by electric signals corresponding to the image signals on the photoconductor drum 1 through the fθ lens (without sign) and reflecting mirror (without sign), so that the static latent image corresponding to the document image is formed on the photoconductive layer on the surface of the photoconductor drum 1.

The developing device 4 as development means accommodates a two-component developer of each of yellow (Y), magenta (M) cyan (C) and black (K), and is equipped with a developing roller 4 a as a developer carrier formed of a cylindrical non-magnetic stainless steel or aluminum material having a thickness of 0.5 through 1 mm and an outer diameter of 15 through 25 mm. The developing roller 4 a is kept at a predetermined interval of e.g. 100 through 1000 μm with the photoconductor drum without contacting each other, by a hitting roller (not illustrated), and is designed to rotate in the same forward direction as the photoconductor drum 1. During development step, the d.c. voltage having the same polarity (negative polarity in the present invention) as that of toner or the development bias voltage obtained by superimposing a. c. current on the d. c. current is applied to the developing roller 4*a*, whereby reversing phenomenon occurs to the exposure section on the photoconductor drum 1. Styrene acryl polymerized toner is used as a developer (toner) for this reversing.

A semiconducting seamless plastic belt member a 1E+7 through 1E+9 Ω·cm or having a volume resistivity of about 1E+7 through 1E+9 Ω and a surface resistivity of about 1E+10 through 1E+12 Ω is used as an intermediate transfer belt 6 as an intermediate transfer body. For example, it includes a semiconducting plastic film substrate, having a thickness of 0.05 through 0.5 mm, composed of the engineering plastic such as modified polyimide, thermoplastic polyimide, ethylene tetrafluoroethylene copolymer, vinylidene polyfluoride and nylon alloy, with conducting material dispersed thereon. As a substrate of the intermediate transfer belt 6, it is also possible to use the semiconducting rubber belt having a thickness of 0.5 through 2.0 mm consisting of silicone rubber or urethane rubber with conducting material dispersed thereon. The intermediate transfer belt 6 is driven by a plurality of roller members including a tension roller 6*a* and is rotatably supported in the vertical direction.

The primary transfer roller 7 is composed of a roller type conductive member using rubber foam such as silicone and urethane, and is provided opposite the photoconductor drum 1 of each color, with the intermediate transfer belt 6 sandwiched in-between. It applies pressure to the back surface of the intermediate transfer belt 6 to form a transfer area adjacent to the photoconductor drum 1. The d. c. constant voltage (of positive polarity in the present embodiment) having a polarity opposite to that of toner is applied to the primary transfer roller 7 by constant voltage control, and the toner image on the photoconductor drum 1 is transferred on the intermediate transfer belt 6 by means of the transfer electric field created in the transfer area.

When the image recording has started, the photoconductor drum 1 of Y is driven in the arrow-marked direction by the operation of a photoconductor drive motor (not illustrated), and a potential is applied to the photoconductor drum 1 of Y by the charging device 2 of Y. After the photoconductor drum 1 of Y is assigned with potential, exposure (image write) by electric signal corresponding to the first color signal, i.e. the image data of Y is carried out by the exposure optical system 3 of Y, and a static latent image corresponding to the image of yellow (Y) is formed on the photoconductor drum 1 of Y. This latent image is reversed by the developing device 4 of Y, and a toner including yellow (Y) toner is formed on the photoconductor drum 1 of Y. The Y toner image created on the photoconductor drum 1 of Y is transferred on the intermediate transfer belt 6 by the primary transfer roller 7 as primary transfer means.

A potential is applied to the photoconductor drum 1 of M by the charging device 2 of M. After the photoconductor drum 1 of M is assigned with potential, exposure (image write) by electric signal corresponding to the first color signal, i.e. the image data of M is carried out by the exposure optical system 3 of M, and a static latent image corresponding to the image of magenta (M) is formed on the photoconductor drum 1 of M. This latent image is reversed by the developing device 4 of M, and a toner including magenta (M) toner is formed on the photoconductor drum 1 of M. The M toner image created on the photoconductor drum 1 of M is transferred on the intermediate transfer belt 6 in the form superimposed on the toner image of Y by the primary transfer roller 7 as primary transfer means.

By the similar process, the toner image including the toner of cyan (C) formed on the photoconductor drum 1 of C, and the toner image including the toner of black (K) formed on the photoconductor drum 1 of K are formed on the intermediate transfer belt 6 in superimposed form, one after the other. Thus, a superimposed color toner image consisting of Y, M, C and K is formed on the peripheral surface of the intermediate transfer belt 6.

The toner remaining on the peripheral surface of each photoconductor drum 1 subsequent to transfer operation is removed by a photoconductor cleaning apparatus 190.

In the meantime, the transfer material P as a transfer material stored in a paper supply cassette 20 is supplied by the feed roller 21 and paper supply roller 22A each provided on the paper supply cassette 20, and is transported to the second transfer roller 7 A as a secondary transfer means where the voltage of the polarity opposite the toner is applied, through a transport roller 22B, 22C and 22D and resist roller 23. In the transfer area of the second transfer roller 7A, superimposed color toner image (color image) formed on the intermediate transfer belt 6 is transferred to the transfer material P in one operation.

The transfer material P with the color image transferred thereon is fixed by being pressurized by a fixing nip portion NA of upwardly convex shape (so as to increase the distortion) formed by the heating roller 240 and pressure roller 250 of the oil-free fixing apparatus 24. Then the transfer material P is held by an ejection roller 17 and is placed on the ejection tray 26 outside the machine through the transport roller 18 provided downstream from the fixing apparatus 24.

After the color image has been transferred onto the transfer material P by the second transfer roller 7 A as a secondary transfer means, the remaining toner removed by an intermediate transfer body cleaning apparatus 190*a* from the intermediate transfer belt 6 having applied curvature-separation of the transfer material P.

After the color image has been transferred onto the transfer material P by the second transfer roller 7A, the remaining toner is removed by an intermediate transfer body cleaning apparatus 8A from the intermediate transfer belt 6 having applied curvature-separation to the transfer material.

Formation of a color image has been discussed in the description of the aforementioned image forming apparatus. At the time of formation of monochromatic images, the aforementioned image forming apparatus provides image formation at a copying rate of 50 cpm.

The following describes the each fixing apparatus of the present invention with reference to the cross sectional view showing the functions of each fixing apparatus 24 given in FIGS. 2 through 6.

Figure 2:
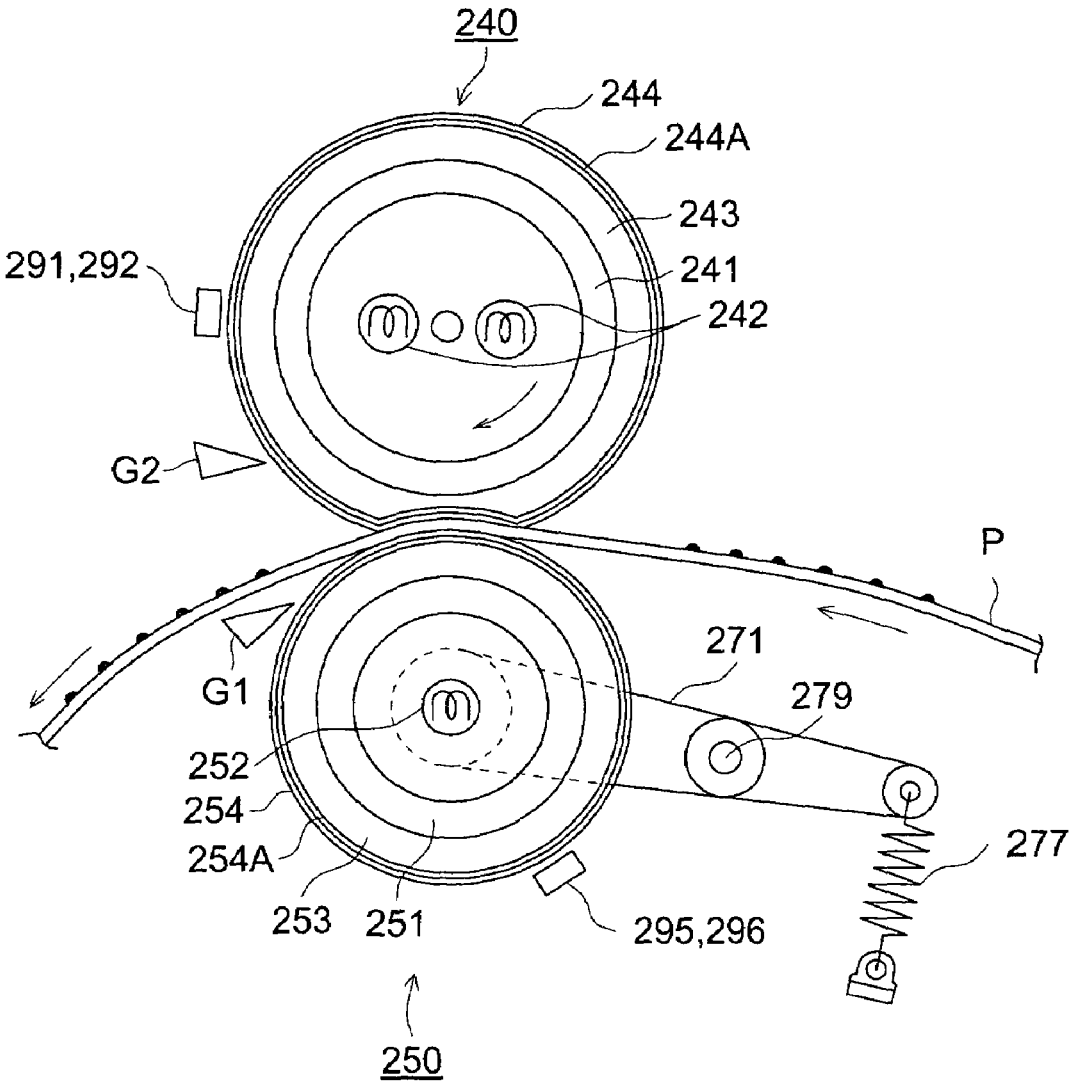
FIG. 2 is a cross sectional view showing the functions in one example of the embodiment of a fixing apparatus of the present invention.

As shown in FIG. 2, the fixing apparatus as a first embodiment has:

a heating roller 240 further having a cylindrical cored bar 421 incorporating a heating source 242, an elastic layer 243 lined around the cylindrical cored bar 241, and a releasing layer 244 for covering this elastic layer surface, with an intermediate layer 244A held in-between;

a pressure roller 250, capable of coming in contact with this heating roller 240 and having the same configuration as the heating roller 240, namely, equipped with a cylindrical cored bar 251 incorporating a heating source 252, an elastic layer 253 lined around the cylindrical cored bar 251, and a releasing layer 254 for covering this elastic layer, with an intermediate layer 254A held in-between. This fixing apparatus 24 has a contacting mechanism 270 installed as energized by a spring 277 so that the lever 271 mounted rotatably rotates the pressure roller 250 around a shaft 279, and the pressure roller 250 is contacted on the heating roller 240. The transfer material P, transported to the nip portion where the aforementioned two rollers are contacted together, with the nonfixed toner image transferred thereto, is held inbetween, and is heated and pressed, whereby the toner image is fixed. Further, a first guide member G1 is provided with the pressure roller 250, and a second guide member G2 is provided with the heating roller 240.

Especially in the first embodiment, the hardness of the pressure roller 250 is greater than that of the heating roller 240, and the difference in hardness is 5 through 10 degrees in AskerC. This arrangement allows the formation of a fixing nip portion, convex-shaped on the side closest to the heater roller. It is preferred that the nip pressure be 24.5 N/cm or more. The second guide member G2 is provided near the heating roller 240 without contacting it, and the first guide member G1 is provided with the pressure roller 250. The first guide member G1 is provided in contact with the pressure roller 250, but it can be provided without contacting it.

As described above, difference in hardness is provided between the heating roller and pressure roller. A fixing nip portion, convex-shaped (upwardly convex in this embodiment) on the side closest to the heating roller is formed. This arrangement avoids jamming of paper onto the upper heating roller. Further, the fixing performance can be stabilized by increasing the nip pressure. The above description of the roller hardness, difference in hardness and nip shape is applicable to the same appearing in any of the subsequent embodiments.

The first guide member should preferably be covered with fluorine resin in order to prevent paper and toner from jamming. In this case, covering or film-like resin may be laminated.

Figure 3:
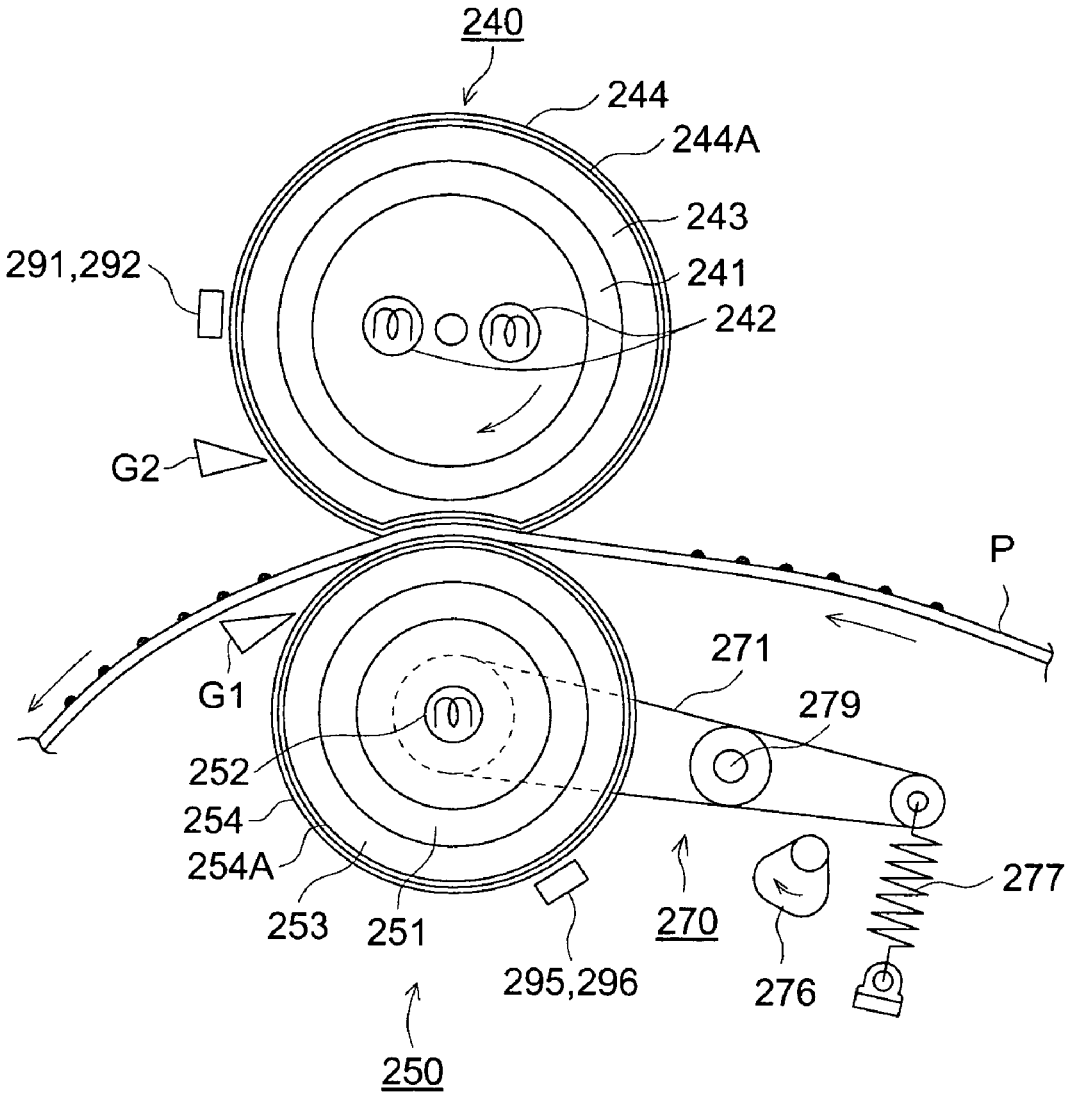
FIG. 3 is a cross sectional view showing the functions in one example of the embodiment of a fixing apparatus of the present invention.

As shown in FIG. 3, the fixing apparatus as a second embodiment comprises:

a heating roller 240 further including a cylindrical cored bar 241 incorporating a heating source 242, an elastic layer 243 lined around the cylindrical cored bar 241, and a releasing layer 244 for covering this elastic layer surface, with an intermediate layer 244 A held in-between;

a pressure roller 250, capable of coming in contact with this heating roller 240 and having the same configuration as the heating roller 240, namely, equipped with a cylindrical cored bar 251 incorporating a heating source 252, an elastic layer 253 lined around the cylindrical cored bar 251, and a releasing layer 254 for covering this elastic layer, with an intermediate layer 254 A held in-between. This fixing apparatus 24 has a contacting mechanism 270 installed as energized by a spring 277 so that the lever 271 mounted rotatably rotates the heating roller 250 around a shaft 279, and the pressure roller 250 is contacted on the heating roller 240. The transfer material P, transported to the nip portion where the aforementioned two rollers are contacted together, with the non-fixed toner image transferred thereto, is held in-between, and is heated and pressed, whereby the toner image is fixed. The hardness of the heating roller 240 and pressure roller 250 and difference in their hardness are the same as those described in the first embodiment. This arrangement allows the formation of a fixing nip portion convex-shaped on the side closest to the heater roller. Further, a first guide member G1 and second guide member G2 are provided.

Further, in the second embodiment, a contact release mechanism 276 as a cam mechanism for releasing contacting of the aforementioned two rollers is provided to disconnect the pressure roller 250 from the heating roller 240. To be more specific, in the warm-up mode, the contact release mechanism 276 as a cam mechanism rotates to contact the lever 271, and contacting of the pressure roller 250 on the heating roller 240 is released against the force of the spring 277. In this manner, if the contacting mechanism 270 and contact release mechanism 276 are provided, even if the nip pressure is 24.5 N/cm or more during regular operation, the nip is released during the warm-up mode, whereby permanent distortion resulting from mutual pressure does not occur on the surfaces of the heating roller 240 and pressure roller 250, even if the aforementioned cylindrical cored bars 241 and 251 of the heating roller 240 and pressure roller 250 are made of aluminum to ensure excellent heat conductivity. Further, this arrangement allows adequate temperature to be reached in a short time, with the result that roller durability and heat efficiency are enhanced and warm-up time is substantially reduced.

As will be described later, non-contact temperature sensors 291 and 295 are provided at the centers of the heating roller 240 and pressure roller 250, and thermister 292 and 296 as temperature detectors are mounted at their ends. Control is provided in such a way that, according to these detection values, the heat sources 242 and 252 are adjusted to ensure that the surface temperatures of both rollers are kept at 200° and 180° C. respectively at all times. This means that, immediately after termination of warm-up, stable fixing can be commenced with both the heating roller 240 and pressure roller 250 maintained at uniform adequate temperature.

Figure 4:
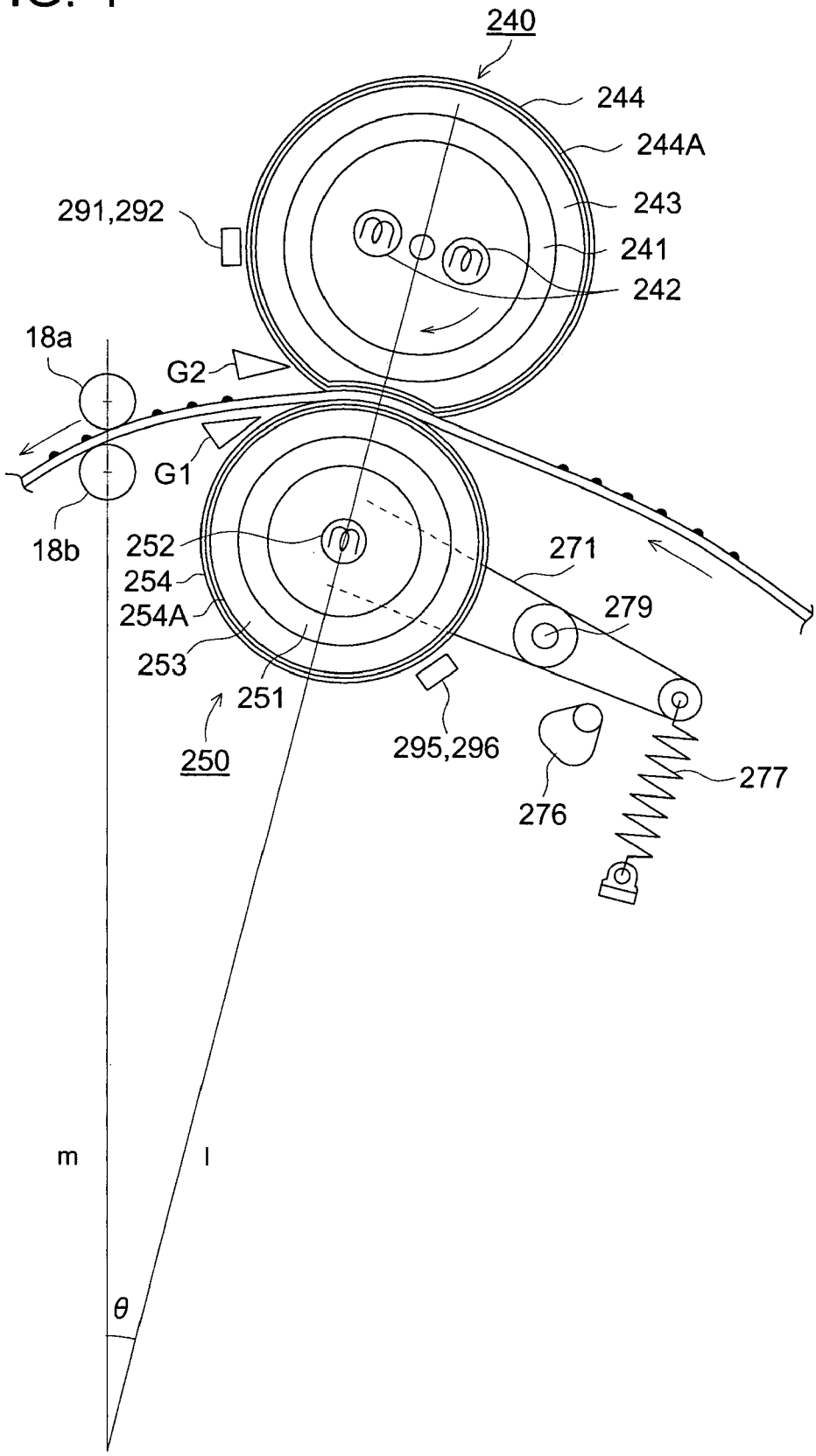
FIG. 4 is a cross sectional view showing the functions in one example of the embodiment of a fixing apparatus of the present invention.

As shown in FIG. 4, the fixing apparatus as a third embodiment comprises a heating roller 240 further including a cylindrical cored bar 241 incorporating a heating source 242, an elastic layer 243 lined around the cylindrical cored bar 241, and a releasing layer 244 for covering this elastic layer surface, with an intermediate layer 244A held in-between. The fixing apparatus as a third embodiment further includes a pressure roller 250, capable of coming in contact with this heating roller 240 and having the same configuration as the heating roller 240, namely, equipped with a cylindrical cored bar 251 incorporating a heating source 252, an elastic layer 253 lined around the cylindrical cored bar 251, and a releasing layer 254 for covering this elastic layer, with an intermediate layer 254A held in-between. The hardness of the pressure roller 250 is at a level higher than that of the heating roller 240. The difference in hardness-between them is 5 through 10 degrees in AskerC. Between two rollers, a fixing nip portion NA, convex-shaped (upwardly convex in this embodiment) on the side closest to the heating roller 240, is formed. The fixing apparatus also contains a contacting mechanism 270 that is installed as energized by a spring 277 so that the lever 271 mounted rotatably rotates around a shaft 279, and the pressure roller 250 is contacted on the heating roller 240. The transfer material P, transported to the nip portion where the aforementioned two rollers are contacted together, with the non-fixed toner image transferred thereto, is held in-between, and is heated and pressed, whereby the toner image is fixed. As shown in FIG. 4, arrangement is provided to ensure that the transfer material P ejected by moving the pressure roller 250 to a position downstream in the transport direction of the transfer material P is transported at least in a flat state in the horizontal direction, and is collected at a higher place. To be more specific, the present embodiment is configures to ensure that a straight line 1 connecting between the axes of the heating roller 240 and pressure roller 250 crosses a straight line m connecting between the axes of the transport rollers 18*a* and 18*b* in a downstream direction, without being parallel thereto. It is preferred that the angle θ between the lines 1 and m be from 1 degree to 10 degrees. As compared to the case where the heating roller 240 as an upper roller and the pressure roller 250 as a lower roller are placed in the vertical direction, an upwardly convex curl is applied to the transfer material P ejected after fixing, and workability is improved without the transfer material P being ejected excessively. Further, the pressure roller 250 is provided with a first guide member G1, and the heating roller 240 is provided with a second guide member G2.

Especially in the third embodiment, a contact release mechanism 276 as a cam mechanism for releasing contacting of the aforementioned two rollers is provided to disconnect the pressure roller 250 from the heating roller 240. Means are provided to ensure that upwardly convex shape is applied to the transfer material by setting the nip pressure to 24.5 N/cm or more. This arrangement provides a more effective way for preventing jamming of paper onto the heating roller 240 as an upper roller.

As shown in FIG. 4, the fixing apparatus as a third embodiment comprises a heating roller 240 further including:

a cylindrical cored bar 241 incorporating a heating source 242;

an elastic layer 243 lined around the cylindrical cored bar 241; and a releasing layer 244 for covering this elastic layer surface, with an intermediate layer 244A held in-between;

a pressure roller 250, capable of coming in contact with this heating roller 240 and having the same configuration as the heating roller 240, namely, equipped with:

a cylindrical cored bar 251 incorporating a heating source 252;

an elastic layer 253 lined around the cylindrical cored bar 251; and a releasing layer 254 for covering this elastic layer, with an intermediate layer 254A held in-between. This fixing apparatus 24 has a contacting mechanism installed as energized by a spring 277 so that the lever 271 mounted rotatably rotates the heating roller 250 around a shaft 279, and the pressure roller 250 is contacted on the heating roller 240. The transfer material P, transported to the nip portion where the aforementioned two rollers are contacted together, with the non-fixed toner image transferred thereto, is held in-between, and is heated and pressed, whereby the toner image is fixed.

Figure 5:
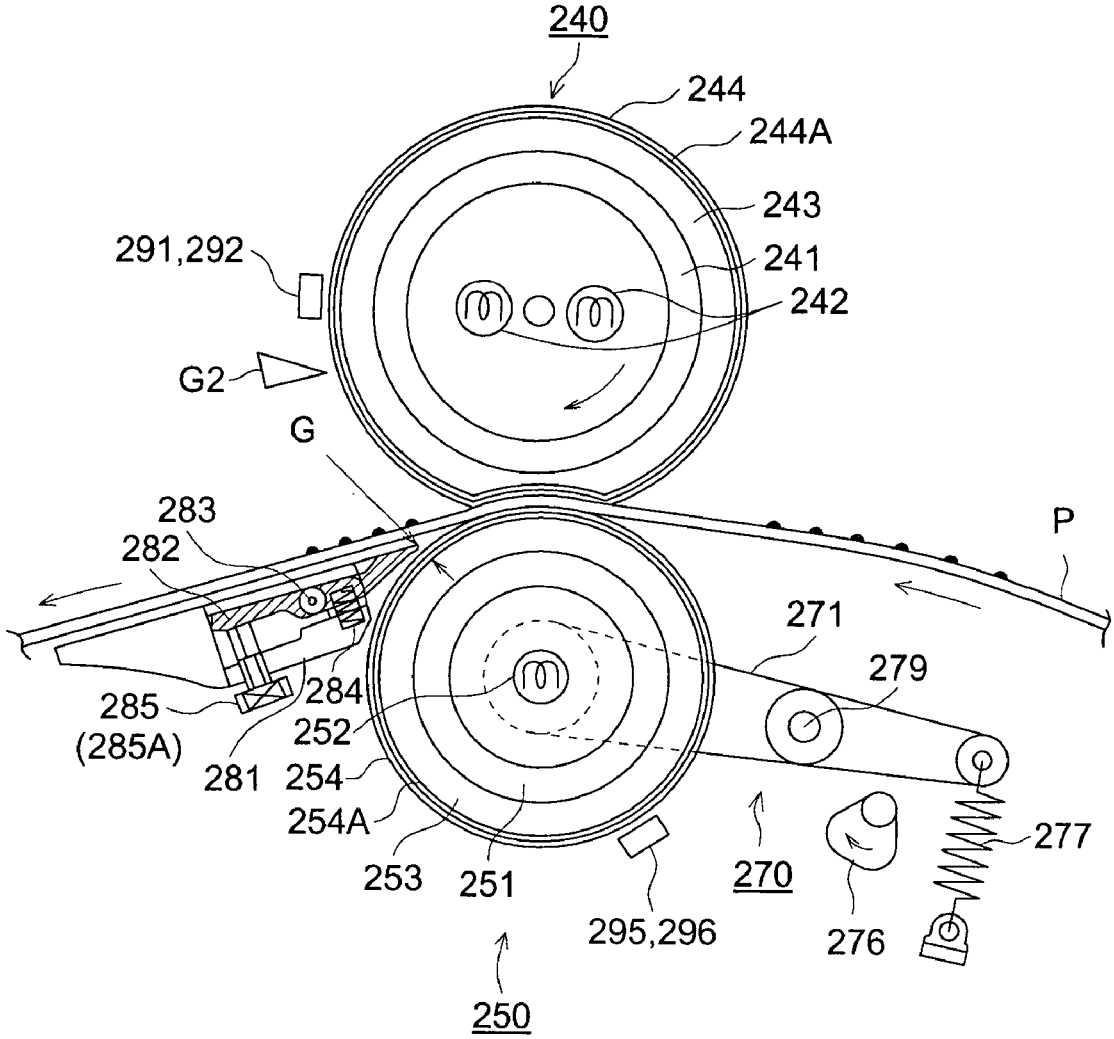
FIG. 5 is a cross sectional view showing the functions in one example of the embodiment of a fixing apparatus of the present invention.

Further, in the fourth embodiment, a contact release mechanism 276 as a cam mechanism for releasing contacting of the aforementioned two rollers is provided to disconnect the pressure roller 250 from the heating roller 240. Means are provided to ensure that upwardly convex shape of the nip is applied to the transfer material by setting the nip pressure to 24.5 N/cm or more. This arrangement prevents jamming of paper onto the heating roller 240 as an upper roller. Further, a jam preventing jaw 282 is provided for preventing jamming of paper onto the pressure roller 250 as the first guide member, as shown in FIG. 5. And a second guide member G2 is provided near the heating roller 240. An adjusting mechanism 285 is provided to allow the gap G between the tip of the jam preventing jaw 282 and the pressure roller 250 to be set to 0.7 or more. The adjusting mechanism 285 has the spindle 283 of the stationary frame 281 mounted rotatably on the jam preventing jaw 282. A spring 284 is arranged between the jam preventing jaw 282 and stationary frame 281, and an adjusting screw 285A as an adjusting mechanism 285 is threaded into the stationary frame 281. The tip of the adjusting screw 285A is made to hit the rear portion of the jam preventing jaw 282 so that the gap G is adjusted to 0.7 mm or less. It should be noted that this gap G is the value when the pressure roller has a room temperature (20° C.). The ratio between the two roller diameters is 1.2 or more, where the larger diameter of the heating roller is set to 60 mm or more.

Figure 6:
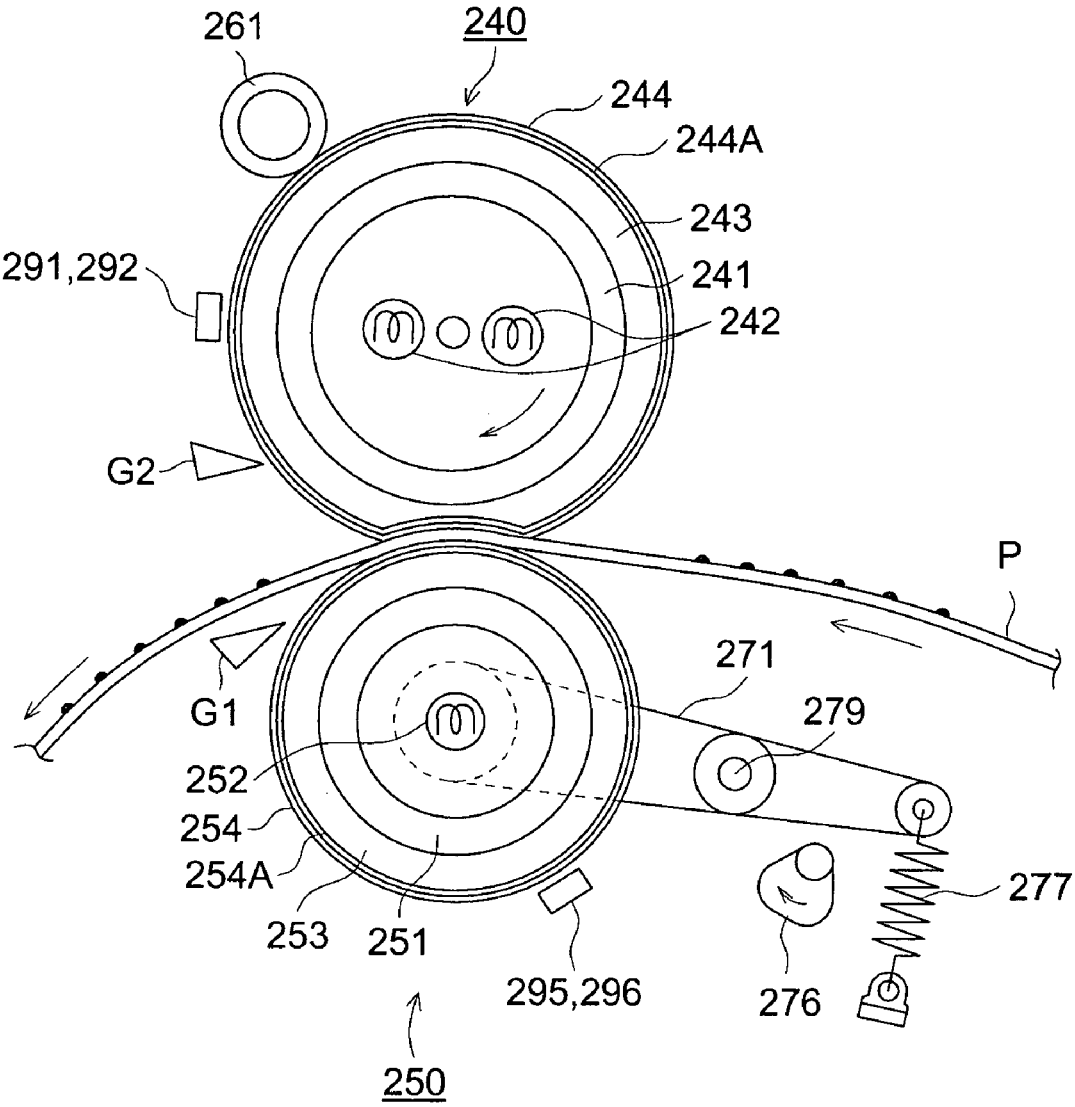
FIG. 6 is a cross sectional view showing the functions in one example of the embodiment of a fixing apparatus of the present invention.

As shown in FIG. 6, the fixing apparatus as a fifth embodiment comprises:

a heating roller 240 further including:

a cylindrical cored bar 241 incorporating a heating source 242;

an elastic layer 243 lined around the cylindrical cored bar 241; and a releasing layer 244 for covering this elastic layer surface, with an intermediate layer 244A held in-between;

a pressure roller 250, capable of coming in contact with this heating roller 240 and having the same configuration as the heating roller 240, namely, equipped with:

a cylindrical cored bar 251 incorporating a heating source 252;

an elastic layer 253 lined around the cylindrical cored bar 251; and a releasing layer 254 for covering this elastic layer, with an intermediate layer 254A held in-between. The heating roller 240 contains a cleaning roller 261 as a cleaning member mounted in contact therewith. This cleaning roller 261 is formed of a rotary body including of a covered metallic material. This fixing apparatus 24 also has a contacting mechanism 270 installed as energized by a spring 277 so that the lever 271 mounted rotatably rotates the heating roller 250 around a shaft 279, and the pressure roller 250 is contacted on the heating roller 240. Further, a first guide member G1 and second guide member G2 are provided.

Further, in the fifth embodiment, a contact release mechanism 276 as a cam mechanism for releasing contacting of the aforementioned two rollers is provided to disconnect the pressure roller 250 from the heating roller 240. To be more specific, in the warm-up mode, the contact release mechanism 276 as a cam mechanism rotates to contact the lever 271, and contacting of the pressure roller 250 on the heating roller 240 is released against the force of the spring 277. In this manner, if the contacting mechanism 270 and contact release mechanism 276 are provided, uniform heating is ensured even if the heating roller 240 comes in contact with the cleaning roller 261, and the pressure roller 250 is also pre-heated relatively uniformly at an appropriate temperature independently by a heating source 252 installed inside.

As will be described later, non-contact temperature sensors 291 and 295 are provided at the centers of the heating roller 240 and pressure roller 250, and thermisters 292 and 296 as temperature detectors are mounted at their ends. Control is provided in such a way that, according to these detection values, the heat sources 242 and 252 are adjusted to ensure that the surface temperatures of both rollers are kept at 200 and 180° C. respectively at all times. this means that, immediately after termination of warm-up, stable fixing can be commenced with both the heating roller 240 and pressure roller 250 as well as the cleaning roller 261 maintained at uniform adequate temperature.

In the present invention, the fluctuation of the surface gloss is reduced by keeping the surface temperatures of the heating roller 240 and pressure roller 250 as well as nip pressure of these rolls at the set values with respect to various types of transfer materials P.

Further, in each fixing apparatus 24 given in FIGS. 2 through 6, the elastic layer 243 of the silicone rubber layer lined on the cored bar 24 of the heating roller 240 having an outer diameter of 65 mm has a thickness of 1.5 mm, the intermediate layer 244A has a thickness of 30 μm, and the releasing layer 244 made of fluorine resin (PFC) has a thickness of 30 μm. A non-contact temperature sensor 291 is mounted at the center of the heating roller 240, with a thermisters 292 as a temperature detector installed at the end. The elastic layer 253 of the pressure roller 250 having an outer diameter of 55 mm has a thickness of 1.0 mm, and both the intermediate layer 254A and the releasing layer 254 have a thickness of 30 μm. A non-contact temperature sensor 295 is mounted at the center of the pressure roller 250, with a thermisters 296 as a temperature detector installed at the end. The heating roller 240 is set at 200° C., while the pressure roller 250 is set at 180° C. Further, the linear speed in the process is 220 mm per second, and the number of sheets of A4-sized paper copied per minute (CPM) is 50. The toner used is polymerized toner.

The hardness of the heating roller 240 is 70 through 80 degrees in AskerC, preferably 72 through 74 degrees. The heating roller 240 used in the-present embodiment has a hardness of 72 degrees. Thus, the hardness of the pressure roller 250 used is 62 through 67 degrees in AskerC.

The steps described above will produce an image forming apparatus, shown in FIG. 1, provided with any of the fixing apparatuses described above with reference to FIGS. 2 through 6.

Figure 7:
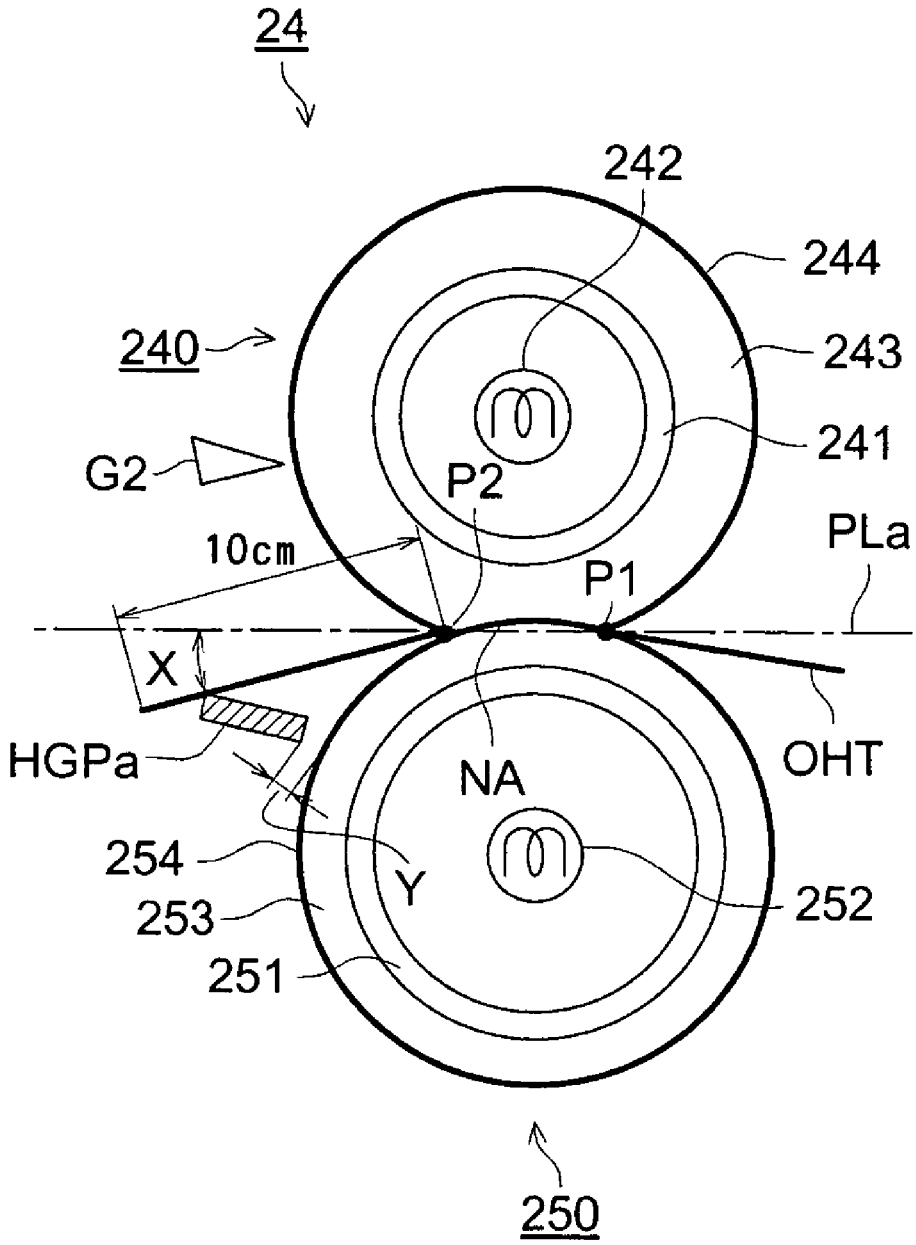
FIG. 7 is a schematic cross sectional view representing the sixth embodiment of the fixing apparatus of the present invention.
Figure 8:
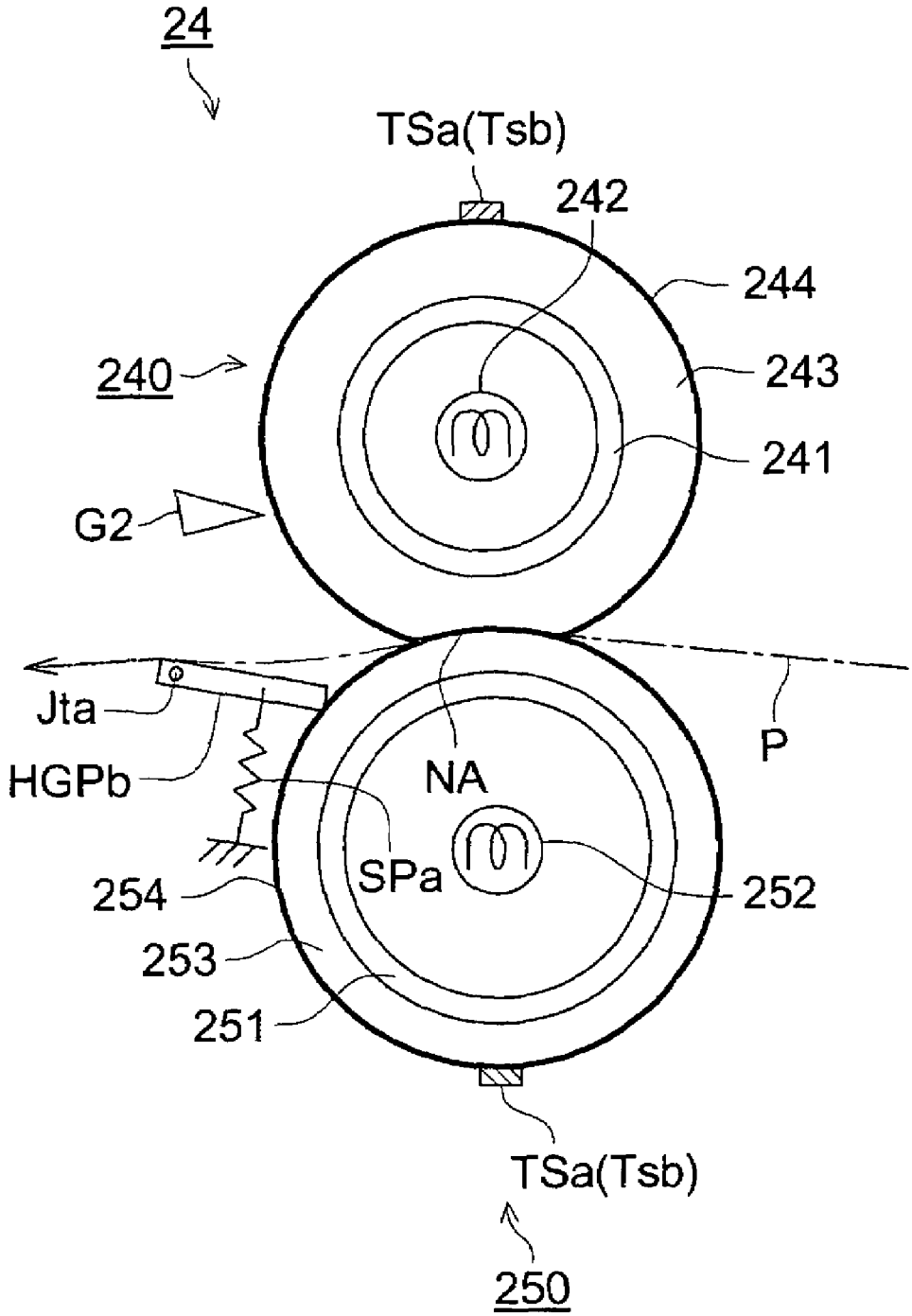
FIG. 8 is a schematic cross sectional view representing an example of the embodiment of a fixing apparatus of the present invention.
Figure 9:
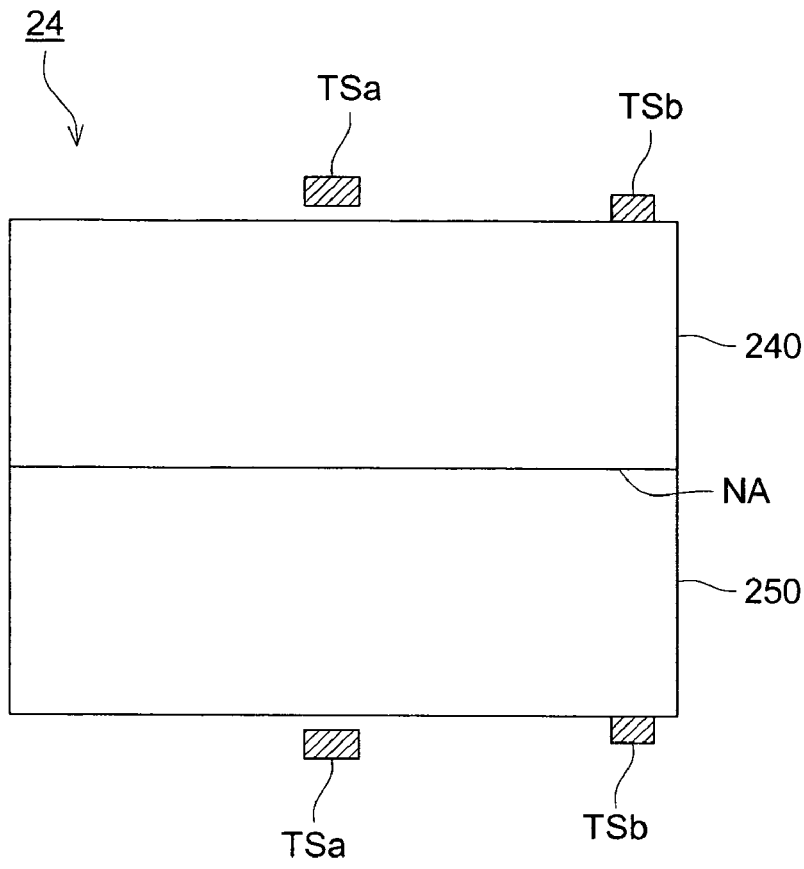
FIG. 9 is a drawing representing the layout of a temperature sensor installed on the fixing apparatus of FIG. 8.

(2) The following describes the fixing apparatus of the present invention with reference to FIGS. 7 through 11: FIG. 7 is a schematic cross sectional view showing the sixth embodiment of the fixing apparatus of the present invention. FIG. 8 is a graph specifying:

the angle between an extension line connecting the crossing points between heating roller and pressure roller on the outlet side of the fixing nip portion, and the transfer material surface; and the adequate area with respect to the gap between the pressure roller member and ejection guide plate. FIG. 9 is a schematic cross sectional view representing the eighth embodiment of a fixing apparatus of the present invention.

Figure 10:
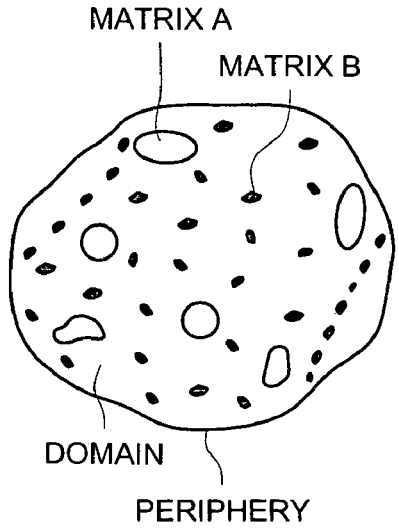
FIG. 10 is a drawing representing the structure of a toner particle used in the present invention.

FIG. 10 is a drawing representing the layout of a temperature sensor installed on the fixing apparatus of FIG. 8. It should be noted that the members having the common functions and configurations in fixing apparatuses of the present invention are assigned with the same symbols.

As shown in FIG. 7, the oil-free fixing apparatus 24 as the sixth embodiment of the present invention comprises:

a heating roller 240 (upper roller) as an upper roll-shaped heating roller member;

a pressure roller 250 (lower roller) as a lower roll-shaped pressure roller member in mechanical contact and engagement with the upper heating roller 240; and an ejection guide plate HGPa as the first guide plate provided on the pressure roller 250 at the outlet side of the fixing apparatus 24. And a second guide member G2 is provided near the heating roller 240.

A heat roller 240 incorporating a halogen lamp 242 as a heating source is designed as a roller member having an outer diameter of about 55 through 70 mm, preferably, 65 mm, comprising:

a cylindrical metallic pipe 241 having an approximate thickness of 1 through 2 mm made of aluminum material, wherein a silicone material, for example, is used on the outer periphery of the cylindrical metallic pipe 241;

a rubber roller layer 243 as a softer elastic layer having a rubber hardness of 70 through 80 degrees (AskerC), preferably 72 degrees and having an approximate thickness of 1 through 3 mm, preferably, 1.5 mm; and a releasing layer 244 consisting of a PFA (perfluoro alkoxy) tube, covered on the surface of the rubber roller layer 253, having a thickness of 15 through 50 μm. An intermediate layer formed when the rubber roller layer 172 a and releasing layer 244 are baked between the rubber roller layer 243 and releasing layer 244, is created between temperature rubber roller layer 243 and releasing layer 244. The temperature of the heating roller 240 is controlled at about 200° C.

A pressure roller 250 is designed as a harder roller having an outer diameter of about 45 through 60 mm, preferably, 55 mm, comprising:

a cylindrical metallic pipe 251 having an approximate thickness of 2 through 5 mm made of STKM (carbon steel pipe for machine structure), wherein a silicone material, for example, is used on the outer periphery of the cylindrical metallic pipe 251;

a rubber roller layer 253 as a harder elastic layer having a rubber hardness of 80 through 90 degrees (AskerC), preferably 83 degrees and having an approximate thickness of 0.8 through 1.2 mm, preferably, 1.0 mm; and a releasing layer 254 covered with a PFA (perfluoro alkoxy) tube having a thickness of 15 through 50 μm, formed on the surface of the rubber roller layer 253. An intermediate layer formed when the rubber roller layer 243 and releasing layer 244 are baked between the rubber roller layer 253 and releasing layer 254, is created between temperature rubber roller layer 253 and releasing layer 254. The temperature of the pressure roller 250 is controlled at about 180° C.

The ejection guide plate HGPa, installed on the pressure roller 250 and used in this embodiment, is the one made of the stainless steel plate material covered with a fluorine resin such as Nitflon Coat. It is also possible to laminate a fluorine resin film thereon.

The heating roller 240 (upper roller) is kept at a temperature of 200° C., and the pressure roller 250 (lower roller) is kept at 180° C. The recording paper P is held by a 5–15 mm thick fixing nip portion NA (nip portion) formed as an upwardly convex shaped part (so as to increase the distortion of the heating roller 240) between the heating roller 240 formed as a somewhat softer hard roller on the upper side and the pressure roller 250 formed as a hard roller on the lower side, and is exposed to heat and pressure at the fixing nip portion NA, resulting in excellent fusing and fixing of a toner image (or color toner image) on the recording paper P carried out at the fixing nip portion NA.

As shown in FIG. 8, the oil-free fixing apparatus 24 of the sixth embodiment of the present invention comprises:

a pressure roller 250 (upper roller) as a roll-shaped heating roller member for fixing a toner image on the recording paper P as a transfer material;

a pressure roller 250 (lower roller) as a lower roll-shaped pressure roller member in mechanical contact and engagement with the upper heating roller 240;

an ejection guide plate HGPa provided on the pressure roller 250 at the outlet side of the fixing apparatus 24;

a non-contact temperature sensor TSa used as a first temperature detecting means at the centers of the heating roller 240 and pressure roller 250, as shown in FIG. 9; and a contact temperature sensor TSb used as a second temperature sensor installed at the ends of the heating roller 240 and pressure roller 250. The temperature detecting means installed at the center and end of the roll provides more accurate temperature control of 850 through 3.

The heating roller 240 and pressure roller 250 are made of the same material as described with reference to FIG. 7. The temperature of the heating roller 240 is controlled at the temperature of about 200° C., and that of the pressure roller 250 is controlled at the temperature of about 180° C. A non-contact thermister is used as the non-contact temperature sensor TSb.

The heating roller 240 (upper roller) is kept at a temperature of 200° C. and the pressure roller 250 is kept at a temperature of 180° C. The recording paper P is held by a 5–15 mm thick fixing nip portion NA (nip portion) formed as an upwardly convex shaped part between the heating roller 240 formed as a somewhat softer hard roller on the upper side and the pressure roller 250 formed as a hard roller on the lower side, and is exposed to heat and pressure at the fixing nip portion NA, resulting in excellent fusing and fixing of a toner image (or color toner image) on the recording paper P carried out at the fixing nip portion NA. The fixing nip portion NA is formed in the upwardly convex shape by assigning differences in the product hardness according the difference between the hardness of the elastic layer (rubber roller layer) of the heating roller 240 and that of the pressure roller 250, with reference to the rubber wall thickness.

The ejection guide plate HGPb used as a first guide member provided on the pressure roller 250 includes the plate formed by treating the stainless steel treated with Nitflon Coat, where the tip is provided with fluorine resin covering. It is rotated about with the rotary shaft Jta and is engaged with the pressure roller 250. The pressure is applied to the ejection guide plate HGPb by the tension spring SPa. HGPb The pressure of the ejection guide plate HGPb on the pressure roller 250 by the tension spring SPa does not exceed 1.5 N HGPb. It should be noted that the pressure refers to the load applied toward the center of the pressure roller 250. The pressure is preferred to be about the dead weight (0.5 N) of the ejection guide plate HGPb. The ejection guide plate HGPb is brought in mechanical contact with the pressure roller 250. As described above, the fixing nip portion NA is formed in an upwardly convex shape and the pressure is specified, whereby the feeding performance of the transfer material of low printing percentage can be upgraded, and jamming of recording paper P onto the pressure roller 250 can be prevented. And a second guide member G2 is provided near the heating roller 240.

As described above, if the fixing nip portion is formed in a upwardly convex shape and the pressure is specified, it becomes possible to provide a fixing apparatus and image recording apparatus wherein the feeding performance of the transfer material of low printing percentage can be upgraded, and jamming of recording paper P onto the pressure roller 250 can be prevented.

Figure 11:
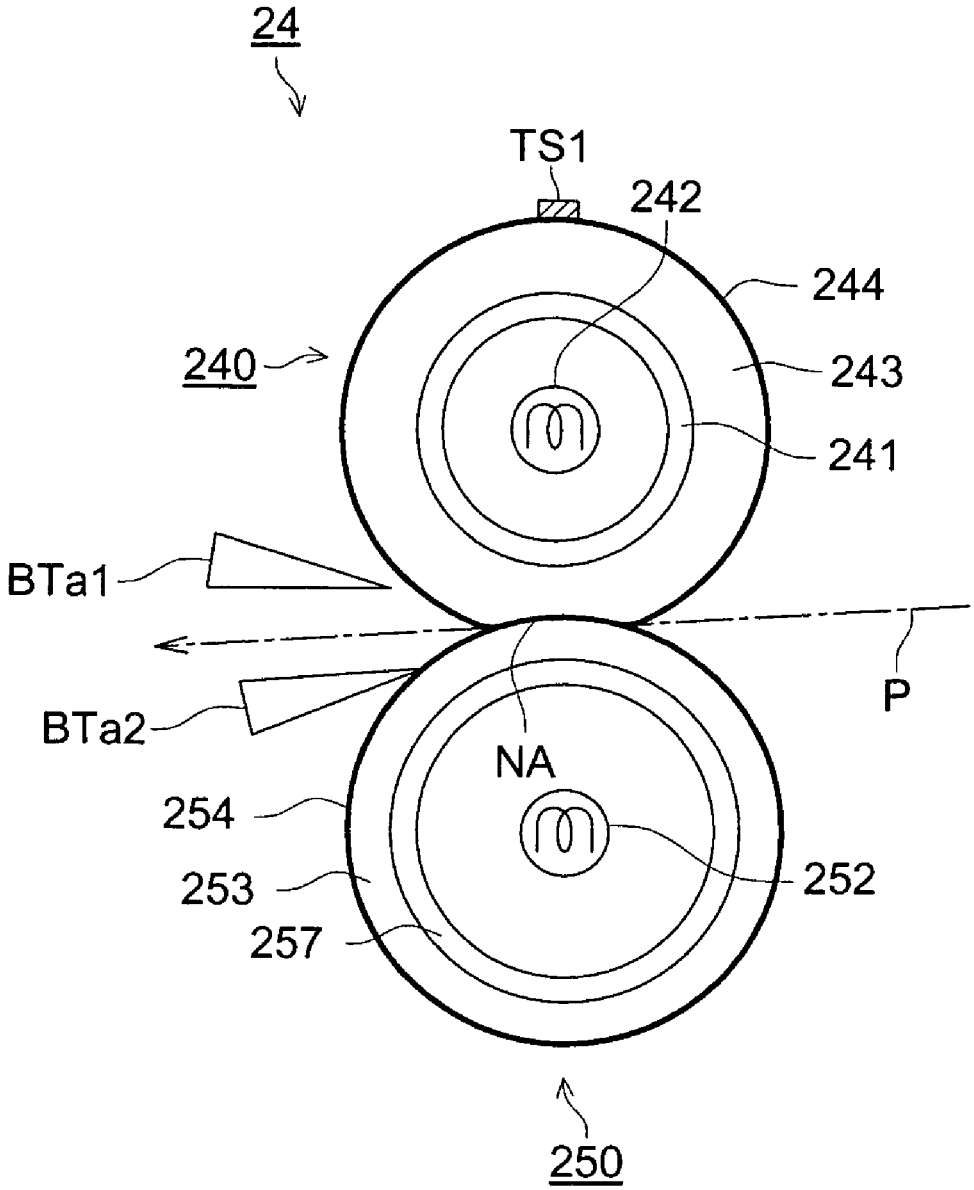
FIG. 11 is a schematic cross sectional view representing a fixing apparatus of the present invention.

(3) The following describes the developer (toner) used in image formation by the aforementioned image forming apparatus with reference to FIG. 11.

The toner used in the present invention is obtained by polymerization of at least a polymerizable monomer in aqueous medium. According to this method of production, the polymerizable monomer is polymerized by the suspension polymerization method to prepare resin particles. Alternatively, after emulsion polymerization is applied to a monomer in a solution (aqueous medium) with required emulsified liquid as additive added thereto, a trace quantity of plastic particles are prepared. After addition of charge controlled plastic particles as required, a coagulant such as organic solvent and salts is added to it, whereby the plastic particles are coagulated and fused.

<Suspension Polymerization>

According to one of the methods of producing toner used in the present invention, change controlled rein is dissolved in the polymerizable monomer, where coloring agent, releasing agent, polymerization initiator or other component materials are added as required. Various components are dissolved or dispersed to the polymerizable monomer, using a homogenizer, sand mill, sand grinder or ultrasonic dispersing apparatus. Using the homomixer or homigenizer, the polymerizable monomer with these components dissolved or dispersed thereto is dispersed in the aqueous medium containing a dispersion stabilizer to form oil drops of a desired size as toner. It is then moved into a reactor (agitation apparatus) as an agitating blade to be described later by an agitating mechanism. Then it is heated to promote polymerization reaction. Upon completion of reaction, the dispersion stabilizer is removed and the substance is filtered, washed and dried, whereby toner the present invention is obtained. It should be noted that the "aqueous medium" refers to the one containing at least 50 percentages by mass of water.

<Emulsion Polymerization>

One of the methods of producing toner used in the present invention is by salting out and fusing of resin particles in aqueous medium. This method includes the methods disclosed in the Official Gazette of Japanese Patent Tokkaihei 5-265252, the Official Gazette of Japanese Patent Tokkaihei 6-329947 and the Official Gazette of Japanese Patent Tokkaihei 9-15904 without being restricted thereto. To be more specific, they are the methods where a plurality of resin particles and dispersed particles of components such as coloring agent or fine particles composed of resins and coloring agents are salting out, coagulation and fusion. Especially, after they are dispersed in water using emulsifier, they are subjected to salting out by adding a coagulant having a density of not less than the critical coagulation density. At the same time, they are heated and fused at not less than glass transition temperature of the formed polymer itself. While fused particles are formed, particle diameters are left to increase gradually. When the target particle diameter has been reached, much water is added to stop the growth in particle diameter. The particle surface is made smooth by further heating and agitation, and the shape is controlled. They are then heated and dried in the fluid state, with water contained therein, whereby the toner used in the present invention is obtained.

The following describes an example of the method of producing the toner used in the present invention:

The toner used in the present invention. Toner particles are formed in aqueous medium by the aforementioned suspension polymerization or emulsion polymerization. The typical method for forming toner particles is disclosed in the Official Gazette of Japanese Patent Tokkai 2002-351142, wherein resin particles are created in aqueous medium, and these resin particles are associated with coloring agent particles, thereby producing toner particles.

An example of producing the toner used in the present invention is disclosed in the aforementioned Official Gazette of Japanese Patent Tokkai 2002-351142, wherein, after the polymerizable monomer has been impregnated with an ester compound as a release agent, the polymerizable monomer is polymerized. The composite resin particles formed through this step are associated with the coloring agent particles, thereby producing the toner particles. This toner production method produces especially preferable toner.

As described above, in the present invention, after obtaining toner particles from the resin particles and coloring agent particles placed in the aqueous medium, filtering is carried out to separate these toner particles from the aqueous medium. At the same time, toner particles are washed in the next step (hereinafter referred to as "filtering/cleaning step"). The filtering/cleaning step contains two steps; one is a filtration step for filtering out the toner particles from the dispersion solution consisting of dispersed toner particles, and the other is a washing step for removing such deposits as surface active agent and salting agent from the filtered toner particles (cake-like aggregate). In the present invention, toner particles are washed using the aforementioned toner particle dispersion solution passage apparatus. The filtration method includes centrifugal separation, vacuum filtration using a Nutsche funnel or the like, and filtration using a filter press or the like.

As described above, the washed toner particles are dried in the following drying step. A drier used in this step includes a spray dryer, vacuum freeze dryer and vacuum dryer. It is preferred to use the stationary drier, movable drier, fluidized bed drier, roller dryer or cylinder agitation dryer.

The toner particles obtained according to the aforementioned typical production methods are the ones having a domain/matrix structure as disclosed in the literature such as the Official Gazette of Japanese Patent Tokkai 2002-351142. It can be seen that the toner particles disclosed in this Official Gazette contains the area different in brightness in the photos of the cross section of the toner particles by the transmission electron microscope. To be more specific, the aforementioned production method is preferable used, and the resultant toner particles obtained are the ones having a domain/matrix structure where granular islands (phases of the releasing agent and coloring agent) different in brightness are present in the continuous phase (phase of the resin) shown in FIG. 10.

In the present invention, particles are formed by such a polymerization process as suspension polymerization and emulsion polymerization. So-called, polymerized toner is used preferably.

Such polymerized toner can be produced by controlling the shape, size or physical properties of the toner particles in the process of toner particle formation. Thus, high-precision digital image can be created when this toner is used in the image forming apparatus of the present invention.

It is preferred that polymerized toner contain release agent. The release agent is effective in preventing offsetting or paper jam.

To get a release agent, addition of low-molecular polypropylene (number-average molecular weight=1500 through 9000) or wax such as low-molecular polyethylene is preferred. Use of the ester compound expressed by the following general formula is preferable:

$$R1—(OCO—R2)n \qquad \text{General formula}$$

In the formula, n denotes the integer from 1 through 4, preferably from 2 through 4, more preferably 3 or 4, particularly preferably 4. R1 and R2 indicate the hydrocarbon group that may contain a substituent.

R1: Carbon number=1 through 40, preferably from 1 through 20, more preferably from 2 through 5

R2: Carbon number=1 through 40, preferably from 16 through 30, more preferably from 18 through 26

The following shows an example of the ester compound that can be expressed by the above-mentioned general formula:

$$CH_3—(CH_2)_{12}—COO—(CH_2)_{17}—CH_3 \qquad 1)$$

$$CH_3—(CH_2)_{18}—COO—(CH_2)_{17}—CH_3 \qquad 2)$$

$$CH_3—(CH_2)_{20}—COO—(CH_2)_{21}—CH_3 \qquad 3)$$

$$CH_3—(CH_2)_{14}—COO—(CH_2)_{19}—CH_3 \qquad 4)$$

$$CH_3—(CH_2)_{20}—COO—(CH_2)_6—O—CO—(CH_2)_{20}—CH_3 \qquad 5)$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

8)

$$CH_3—(CH_2)_{22}—COO—CH_2—\underset{CH_3}{\overset{CH_3}{\overset{|}{\underset{|}{C}}}}—CH_2—O—CO—(CH_2)_{22}—CH_3$$

-continued

9)

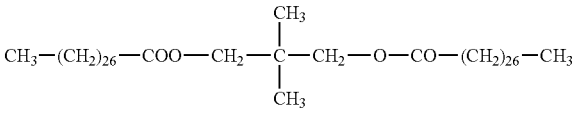

10)

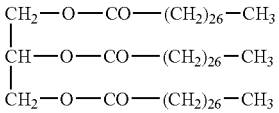

11)

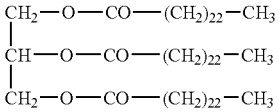

12)

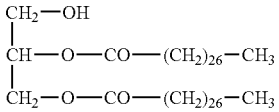

13)

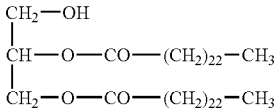

14)

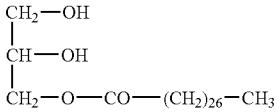

15)

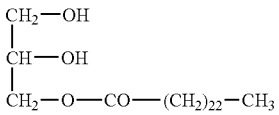

16)

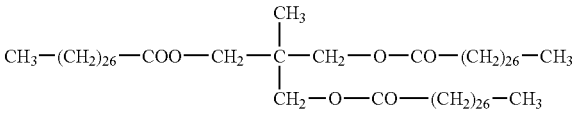

17)

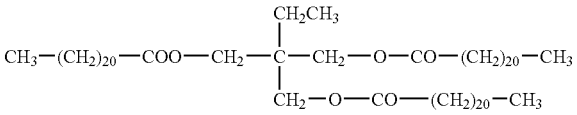

18)

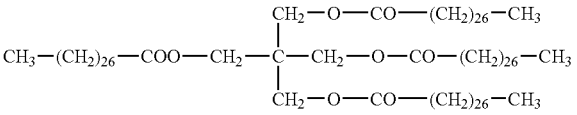

19)

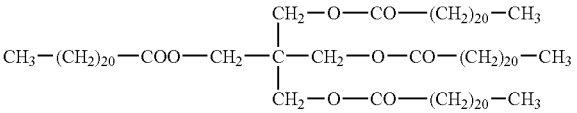

20)

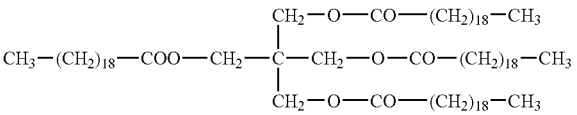

-continued

21)

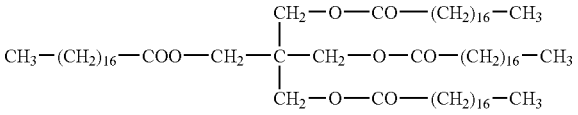

The content of the release agent can be determined as follows: Toner is exposed to ultrasonic vibration in ethanol having a normal temperature (15 through 25° C.) to separate external additives. Solid particles are taken out by centrifugal separation. In the similar manner, resin components are dissolved and removed by methyl ketone at the normal temperature (15 through 25° C.).

After that, the structure is analyzed by mass analysis and gel permission chromatography (GPC).

The endothermic capacity of the release agent per gram of toner by toner DSC measurement is obtained by DSC measurement, and the content of release agent in toner can be obtained from the endothermic capacity. The maximum endothermic capacity of the release agent is preferred to lie in the range from 55 through 105° C., and particularly preferred to be from 63 through 85° C.

It is preferred that the melting point of the release agent be 75 through 119° C. This ensures smooth seepage and dissolution of wax from the toner image at the fixing nip portion, and prevents offset or paper jam more effectively.

As described above, use of the suspension polymerization or emulsion polymerization as a developer (toner) makes it possible to provide an image forming apparatus wherein the feeding performance of the transfer material of low printing percentage can be upgraded, and jamming of transfer material P onto the pressure roller 250 can be prevented more effectively.

As described above, the configuration of the present invention makes it possible to provide a fixing apparatus and an image forming apparatus wherein the feeding performance of the transfer material of low printing percentage can be upgraded, and jamming of transfer material P onto the pressure roller 250 can be prevented.

(2) The following describes the embodiment of the present invention with reference to FIG. 11. FIG. 11 is schematic cross sectional view of a fixing apparatus of the present invention.

In the present invention, the heating roller member (heating roller) and pressure roller member (pressure roller) use the same elastic layer (rubber roller layer), and the thickness of the elastic layer of the heating roller member is made smaller than that of the elastic layer of the pressure roller member. At the same time, the hardness of the pressure roller member is made higher than that of the heating roller member. An upwardly convex shaped fixing nip portion is formed by the difference in hardness between the heating roller member and pressure roller member. A separation jaw or guide plate as a second guide member of the heating roller member is mounted without touching the heating roller member. At the same time, a separation jaw or guide plate as a first guide member of the pressure roller member is mounted in contact with it.

As shown in FIG. 11, the oil-free fixing apparatus 24 of the present invention comprises:

a heating roller 240 as an upper roll-like heating roller member for fixing the toner image on the recording paper P as a transfer material;

a pressure roller 250 as a lower roll-like pressure roller member in mechanical contact and engagement with the upper heating roller 240;

a separation jaw BTa1 as a second guide member installed without touching the pressure roller 250 at the outlet of the heating roller 240; and a separation jaw BTa2 as a first guide member installed in contact with the pressure. Guide plates may be installed instead of separation jaws BTa1 and BTa1.

The heating roller 240 incorporating a halogen lamp 242 as an internal heat source is configured as a roller member having an external diameter of 55 through 70 mm, preferably, 65 mm, comprising:

a cylindrical metallic pipe 241 having an approximate thickness of 1 through 2 mm made of aluminum material, wherein a silicone material, for example, is used on the outer periphery of the cylindrical metallic pipe 241;

a rubber roller layer 243 as a softer elastic layer having a rubber hardness of 70 through 80 degrees (AskerC), preferably 72 degrees and having an approximate thickness of 1 through 3 mm, preferably, 1.5 mm; and a releasing layer 244 consisting of a PFA (perfluoro alkoxy) tube, covered on the surface of the rubber roller layer 253, having a thickness of 15 through 50 μm. As halogen lamps 242 mounted inside the heating roller 240, two 750-watt (approximately) halogen lamps are used in the present embodiment. These two halogen lamps 242 rated at 230 volts are used at 220 volts.

The pressure roller 250 has a cylindrical metallic pipe 251 having an approximate thickness of 2 through 5 mm made of STKM (carbon steel pipe for machine structure). A silicone material, for example, is used on the outer periphery of this cylindrical metallic pipe 251. It also has a rubber roller layer 253 as a harder elastic layer having a rubber hardness of 80 through 90 degrees (AskerC), preferably 83 degrees and having an approximate thickness of 0.8 through 1.2 mm, preferably, 1.0 mm. A releasing layer 254 covered with a PFA (perfluoro alkoxy) tube having a thickness of 15 through 50 μm is formed on the surface of the rubber roller layer 253. In general, the pressure roller 250 is designed as a harder roller having an outer diameter of about 45 through 60 mm, preferably 55 mm. Further, as shown in the drawing, it is also possible to install a halogen lamp 252 as a heat source inside the pressure roller 250. As the halogen lamp 252 mounted inside the pressure roller 250, one 550-watt (approximately) halogen lamp is used in the present embodiment. This halogen lamp 252 rated at 230 volts is used at 220 volts.

As described above, the thickness of the rubber roller layer 253 of the pressure roller 250 of the fixing apparatus 24 is made smaller than that of the rubber roller layer 243 of the heating roller 240. At the same time, the hardness of rubber roller layer 253 of the pressure roller 250 of the fixing apparatus 24 is made higher than that of the rubber roller layer 243 of the heating roller 240. When-the thickness of the rubber roller layer 253 of the pressure roller 250 of the fixing apparatus 24 is made smaller than that of the rubber roller layer 243 of the heating roller 240, and the hardness of rubber roller layer of the pressure roller 250 of the fixing apparatus 24 is made higher than that of the rubber roller layer 243 of the heating roller 240. A fixing nip portion NA, convex-shaped (upwardly convex in this embodiment) on the side closest to the heating roller 240, is formed, wherein the heating roller 240 side is convex.

The separation jaw BTa1 installed without touching the heating roller 240 (upper roller) used here is the one obtained by covering the surface of the heat registrant resin such as polyimide (PI) with PFTE (polytetrafluoro ethylene), wherein the gap with respect to the heating roller 240 is 0.75 mm. In addition, the one with film applied thereto can also be used. Similarly to the separation jaw BTa1, the separation jaw BTa2 mounted in contact with the pressure roller 250 (lower roller) (with a gap of 0 mm) is the one obtained by covering the surface of the heat resistant resin such as polyimide (PI) with PFTE (polytetrafluoro ethylene).

The heating roller 240 (upper roller) is kept at a temperature of 200° C., and the pressure roller 250 (lower roller) is kept at 140° C. or less. The recording paper P is held by a 5–15 mm thick fixing nip portion NA (nip portion) formed as an upwardly convex shaped part between the heating roller 240 formed as a somewhat softer hard roller on the upper side and the pressure roller 250 formed as a hard roller on the lower side, and is exposed to heat and pressure, resulting in excellent fusing and fixing of a toner image (or color toner image) on the recording paper P carried out at the fixing nip portion NA.

The temperature sensor TS1 in contact to the heating roller 240 or without touching it is provided to control the temperature of the heating roller 240 and pressure roller 250. Similarly to the case of FIG. 9, this sensor is mounted, preferably, at the center and end of the pressure roller. This arrangement allows the temperature to be set at a level not exceeding 140° C. over the entire surface of the pressure roller.

As described above, styrene acryl polymerized toner is used as a developer (toner). The separation jaw BTa1 of the heating roller 240 is installed without touching it, and a separation jaw BTa2 of the pressure roller 250 in contact with it. The pressure roller 250 (lower roller) is kept at a temperature not exceeding 140° C. The temperature (of the lower roller) is set in such a way that when a double-sided image is formed in the image forming apparatus described with reference to FIG. 1, for example, the toner image on the first side (surface) again dissolves at the time of duplex copying and a damage by the separation jaw BTa2 is not conspicuous. Thus, a paper jam on upper and lower rollers (heating roller 240 and pressure roller 250) is prevented. At the same time, this arrangement avoids appearance of a damage on the image caused by the separation jaw BTa2 of the lower roller (pressure roller) when the double-sided image is formed.

(Embodiment)

The following test was conducted using the fixing apparatus having the arrangement described with reference to FIG. 11 in the image forming apparatus of FIG. 1, and the aforementioned styrene acryl polymerized toner as the developer (toner). The major image forming conditions are as follow:

Recording paper P: Plain paper with a thickness of 55 kg/m$^2$

Environmental conditions: temperature at 20° C.; humidity at 50%

Process speed (linear velocity): 220 mm/sec. (40 A4-sized documents horizontal feed)

Number of copies: 50 cpm

Charge potential (at non-exposed portion): −750 V

Maximum potential at exposure section: −30 V or less (from 0 through −30 V)

Development: Two-component non-contact developer with application of DC+AC; DC bias fixed at −650 V With the AC frequency fixed at 8 kHz, AC bias amplitude and development roller speed are changed to set the optimum conditions.

Transfer: The optimum conditions are set by adjusting the transfer current.

<Fixing Apparatus>

The following fixing apparatus was used:

Fixing apparatus: The oil-free fixing apparatus 24 described with reference to FIG. 11 was employed under the following conditions:

Heating roller: Has an outer diameter of 65 mm, with the rubber roller layer having a thickness of 1.5 mm. Hardness was 72 degrees in AckerC. Further, two 750-watt halogen lamps rated at 230 were inserted in the heating roller and were used at 220 volts to set the temperature at the level of 200° C.

Pressure roller: Has an outer diameter of 50 mm, with the rubber roller layer having a thickness of 1.0 mm. Hardness was 83 degrees in AckerC. Further, a 230-watt halogen lamp rated at 230 was inserted in the pressure roller and was used at 220 volts.

Upper separation jaw (separation jaw BTa1): Made of polyimide (PI) covered with polytetrafluoro ethylene (PTFE). Has a gap of 0.75 mm with respect to the heating roller.

Lower separation jaw (separation jaw BTa2): Made of polyimide (PI) covered with polytetrafluoro ethylene (PTFE). Has a gap of 0.00 mm with respect to the pressure roller.

<<Image Evaluation Test>>

The temperature o the pressure roller (lower roller) was changed under the aforementioned conditions, and a test conducted on the damage on the image caused the separation jaw of the lower roller (pressure roller) at the time of double-sided image formation. The test result is given in Table 1:

TABLE 1

| Temperature of pressure roller member (° C.) | Damage on image |
|---|---|
| 100 | A |
| 110 | A |
| 120 | A |
| 130 | A |
| 140 | A |
| 150 | B |
| 160 | B |
| 170 | C |
| 180 | C |

A: No damage on the image
B: Slight damage on the image

As shown in Table 1, the temperature of the pressure roller member (pressure roller or lower roller) is kept at 140° C. or less, whereby a damage on the image that may be caused by the separation jaw (separation jaw BTa2) does not occur. A slight damage occurs when the temperature is 150° C. or more, but this does not raise any problem in practical operation.

As described above, the aforementioned arrangement provides a fixing apparatus characterized by absence of a transfer material jam on upper and lower rollers (heating roller member and pressure roller member). At the same time, this arrangement does not allow appearance of a damage on the image caused by the contact of the transfer material with the separation jaw of the lower roller (pressure roller member) in the double-sided image formation.

Thus, jamming of a transfer material on the heating roller as an upper roller is prevented, and a fixed image characterized by stable fixing performances is provided.

The present invention avoids the phenomenon of creeping where permanent distortion occurs on the surfaces of the heating roller and pressure roller, even if a cored bar of high thermal conductivity is utilized. It also cuts down warm-up time, and significantly improves the heat efficiency.

The present invention makes it possible to avoid lowering of the paper ejection position due to an upwardly convex shaped nip, and permits flat paper feed and a high ejection position to be ensured, with the result that user handling performance is enhanced.

The present invention solves the problem involved in jamming of a transfer material onto the heating roller as an upper roller. It also avoids possible jamming of a transfer material onto the pressure roller as a lower roller. This provides a fixed image characterized by further stabilized fixing performance.

Uniform temperature distribution and reduced warm-up time are ensured even if the cleaning roller is brought in contact with the surface of the pressure roller.

The present invention avoids jamming and offsetting involved therein, and provides uniform temperature of the heating roller and pressure roller and uniform nip pressure, with the result that there is no uneven surface gloss.

Further, by specifying the angle between an extension line connecting the crossing points between heating roller member and pressure roller member on the outlet side of the fixing nip portion, and the transfer material surface, as well as the gap between the pressure roller member and ejection guide plate, the present invention provides a fixing apparatus wherein paper feeding performance of the transfer material of high printing percentage is upgraded and jamming of the transfer material on the pressure roller member is prevented.

Further, by adopting an upwardly convex shaped fixing nip and specifying the pressure, the present invention provides a fixing apparatus wherein paper feeding performance of the transfer material of high printing percentage is upgraded and jamming of the transfer material on the pressure roller member is prevented.

Further, by specifying the angle between an extension line connecting the crossing points between heating roller member and pressure roller member on the outlet side of the fixing nip portion, and the transfer material surface, as well as the gap between the pressure roller member and ejection guide plate, the present invention provides a fixing apparatus wherein paper feeding performance of the transfer material of high printing percentage is upgraded and jamming of the transfer material on the pressure roller member is prevented.

Further, by adopting an upwardly convex shaped fixing nip and specifying the pressure, the present invention provides a fixing apparatus wherein paper feeding performance of the transfer material of high printing percentage is upgraded and jamming of the transfer material on the pressure roller member is prevented.

By using the suspension polymerization or emulsion polymerization as a developer (toner), the present invention provides a fixing apparatus wherein paper feeding performance of the transfer material of high printing percentage is upgraded and jamming of the transfer material on the pressure roller member is prevented.

The present invention provides a fixing apparatus characterized in that a transfer material jam on upper and lower rollers (heating roller member and pressure roller member) does not occur, and no damage appears on the image, that might have been caused by the contact of the transfer material with the separation jaw of the lower roller (pressure roller member) in the double-sided image formation.

What is claimed is:

1. A fixing apparatus for fixing polymerized toner on transfer material comprising:

a) a heating roller having a cylindrical cored bar, a elastic layer and releasing layer provided around said cylindrical cored bar;

b) a pressure roller, in contact with the heating roller, having a cylindrical cored bar, a elastic layer and releasing layer provided around said cylindrical cored bar;

c) a first guide member provided opposite the pressure roller; and d) a second guide member provided near the heating roller without contacting thereto;

wherein the difference in hardness between the heating roller and pressure roller is 5 through 10 degrees in AskerC, the hardness of the pressure roller being higher than that of the heating roller, and a fixing nip portion, convexshaped on the side closest to the heating roller, is formed between the heating roller and pressure roller, and the nip pressure of the fixing nip portion is 24.5 N/cm or more.

2. The fixing apparatus of claim 1, wherein the first guide member is covered with fluorine resin.

3. The fixing apparatus of claim 1, wherein when the first guide member is on contact, the pressure of the tip toward the center axis of the pressure roller is smaller than 1.5 N.

4. The fixing apparatus of claim 1, wherein the surface, which contains the center axis of the heating roller and the center axis of the pressure roller, intersects the surface which contains both the center axes of a pair of transport rollers which are provided at downstream of the heating roller and transport the transfer material.

5. The fixing apparatus of claim 1, wherein at least one of the cylindrical cored bars is made of aluminium.

6. The fixing apparatus of claim 1, wherein at least one of the releasing layers is made of tetrafluoroethylene perfluoroalkylvinylether copolymer.

7. The fixing apparatus of claim 1, wherein the thickness of the elastic layer of the pressure roller is smaller than that of the elastic layer of the heating roller.

8. The fixing apparatus of claim 1, comprising a contact release mechanism for releasing and contacting the heating roller and the pressure roller, wherein at the warm-up period, the contact release mechanism releases contacting and only the heating roller is rotated.

9. The fixing apparatus of claim 1, comprising a gap adjusting mechanism for adjusting a gap between the tip of the first guide member and the pressure roller.

10. The fixing apparatus of claim 9, wherein the gap adjusting mechanism allows the gap to be adjusted to a level not larger than 0.7 mm.

11. The fixing apparatus of claim 1, comprising a temperature sensor for detecting the temperature of the pressure roller.

12. The fixing apparatus of claim 11, comprising a control means for controlling the temperature of the pressure roller at a level not larger than 140° C.

13. The fixing apparatus of claim 11, wherein the temperature sensor has a first temperature sensor for detecting the temperature at the center of an axial direction of the pressure roller and a second temperature sensor for detecting the temperature at the ends thereof.

14. The fixing apparatus of claim 1, wherein the uppermost surface of the pressure roller is covered with fluorine resin.

15. The fixing apparatus of claim 1, wherein the diameter of the heating roller is greater than that of the pressure roller, and the ratio between the diameters of the both rollers is at least 1.1, with the diameter of the heating roller being at least 60 mm.

16. The fixing apparatus of claim 1, wherein the heating roller has the elastic layer lined around the cored bar and the releasing layer for covering the surface of the elastic layer, and the pressure roller has the elastic layer lined around the cored bar and the releasing layer for covering the surface of the elastic layer.

17. The fixing apparatus of claim 1, wherein the cylindrical cored bar of the heating roller and the cylindrical core bar of the pressure roller have an internal heating source.

18. An image forming apparatus comprising:

a) an image forming section for forming a toner image using the suspension polymerized or emulsion polymerized toner on a photoconductor;

b) a transfer section for transferring transfer material onto the formed toner image;

c) a fixing section for fixing the transfer material with the toner image transferred thereon;

the fixing section comprising:

a heating roller having a cylindrical cored bar, an elastic layer lined around the cored bar, and a releasing layer for covering the surface of the elastic layer;

a pressure roller, in contact with the heating roller from below, having a cylindrical cored bar, an elastic layer lined around the cored bar, and a releasing layer for covering the surface of the elastic layer;

a first guide member provided opposite to the pressure roller; and a second guide member provided near the heating roller without contacting thereto, wherein the difference in hardness between the heating roller and the pressure roller is 5 through 10 degrees in AskerC, the hardness of the pressure roller being higher than that of the heating roller, and an upwardly convex shaped fixing nip portion is formed between the heating roller and the pressure roller, and the nip pressure of the fixing nip portion is 24.5 N/cm or more.

19. The image forming apparatus of claim 18, where the first guide member is covered with fluorine resin.

20. The image forming apparatus of claim 19, wherein the cylindrical cored bar has a heating source internally.

* * * * *